United States Patent [19]

Fischer et al.

[11] 4,382,585

[45] May 10, 1983

[54] COOLING PLATE FOR FURNACES

[75] Inventors: Horst Fischer; Hermann Bünemann, both of Osnabrueck; Bernhard Henneken, Oberhausen; Bruno Kämmerling, Dinslaken, all of Fed. Rep. of Germany

[73] Assignee: Kabel-u. Metallwerke Gutehoffnungshütte AG, Hanover, Fed. Rep. of Germany

[21] Appl. No.: 126,935

[22] Filed: Mar. 3, 1980

[30] Foreign Application Priority Data

Feb. 26, 1979 [DE] Fed. Rep. of Germany ..... 2907511

[51] Int. Cl.[3] ..... F27D 1/12

[52] U.S. Cl. ..... 266/190; 266/193

[58] Field of Search ..... 266/190–199

[56] References Cited

U.S. PATENT DOCUMENTS

| | | | |
|---|---|---|---|
| 2,859,030 | 11/1958 | Snyder | 266/192 |
| 3,002,734 | 10/1961 | Koopal | 266/199 |
| 3,378,249 | 4/1968 | French | 266/190 |
| 4,304,396 | 12/1981 | Udoh | 266/241 |

*Primary Examiner*—P. D. Rosenberg

*Attorney, Agent, or Firm*—Ralf H. Siegemund

[57] ABSTRACT

A copper or copper alloy ingot is forged or rolled into a plate; blind bores are deep-drilled into the plate from one of its narrow edges and plugged; inlet and outlet nipples for the ducts are provided on the rear surface; and the front surface of the plate is provided with grooves or short sleeves for holding a fireproof lining structure or material.

16 Claims, 6 Drawing Figures

FIG. 4
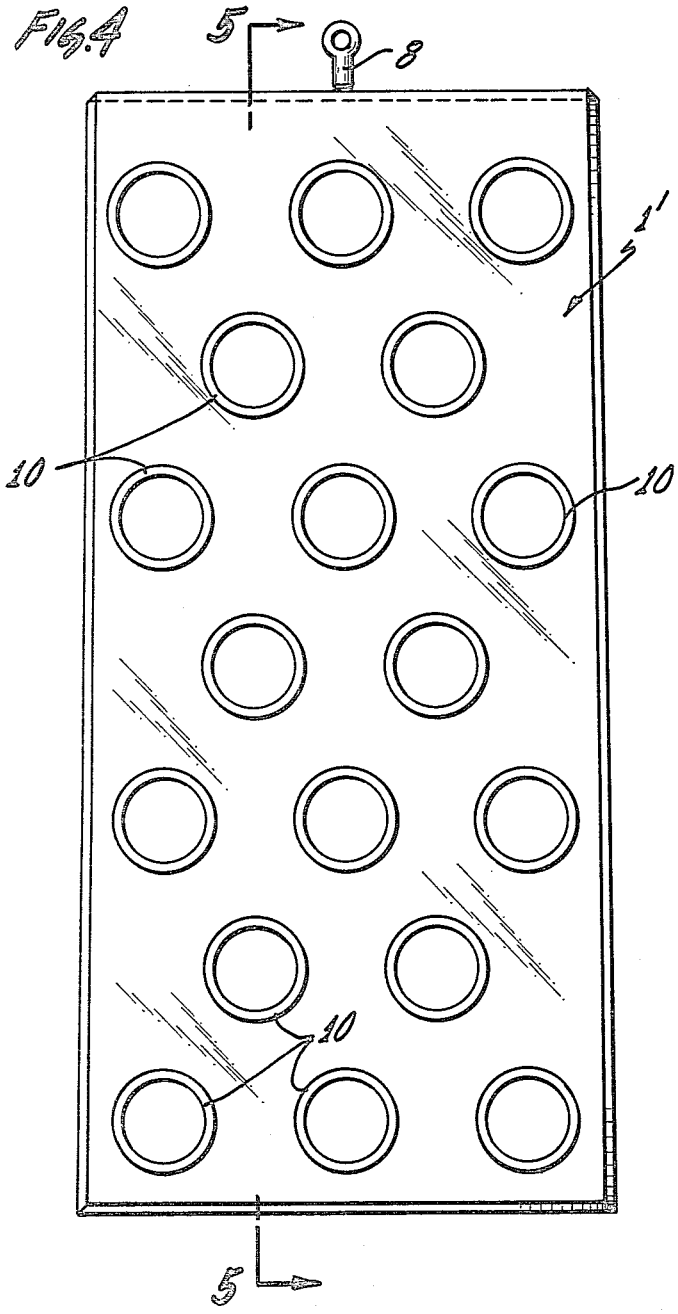
FIG. 5
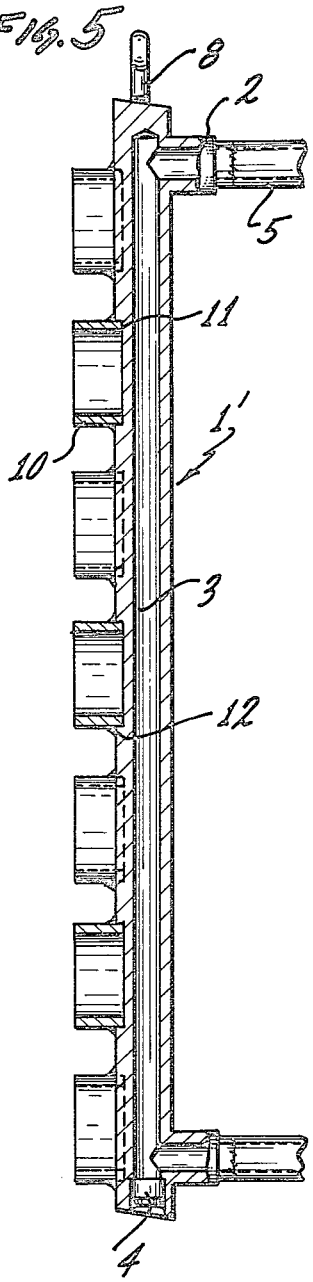
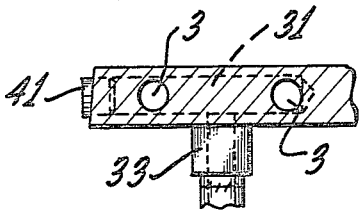
FIG. 6

COOLING PLATE FOR FURNACES

BACKGROUND OF THE INVENTION

The present invention relates to a flat, cooling device to be used in a pit furnace such as a blast furnace, or the like, having a fireproof lining or casing; and more particularly, the invention relates to a copper plate or a low-alloyed copper plate to be used for cooling such a furnace and having internal cooling channels.

Flat cooling devices or plates of the type to which the invention pertains are usually arranged between the shell of such a furnace, e.g., a blast furnace, and a brick lining thereof. The cooling ducts or channels are connected to a suitable circulation system for a coolant. The cooling plates themselves are covered on one side with a fireproof lining, the side being the one facing the interior of the furnace.

Plates for cooling, having the foregoing features, are known to be made of cast iron; and pipes are embedded therein. The heat transfer through these plates is quite poor for two reasons. For one, the thermal conductivity of cast iron is rather low; the other reason is an added resistance against heat flow across the pipe-plate interface; there may even be a gap, oxide layer, or both.

In some cases, the brickwork of the furnace casing is damaged, deteriorates with age, etc., so that the inside surface of the cooling device is, locally at least, directly exposed to the hot furnace chamber. Since the operating temperature of a blast furnace is well above the melting point of cast iron and since the poor heat transfer conditions through the plate (supra) do not lead to adequate cooling of the inside surface of the cast iron plate, the plate will wear out and deteriorate rather rapidly. Thus, the life of such a cooling device is quite limited.

Another known variety of cooling plates is made of cast copper, either being directly provided with internal cooling ducts, or tubes for the coolant are embedded in the cast. The texture of cast copper is not as homogenic and dense as the texture of forged or rolled copper. Thus, the heat transfer through cast copper is not as good as through a denser and more homogenic copper. Also, cast copper is not as strong. Moreover, separate, embedded cooling tubes inevitably carry an oxide layer which impedes the heat transfer into the tubes. On the other hand, integral ducts in cast copper plates have frequently rather rough walls and uneven surfaces. The surfaces may even carry embedded sand from the casting. All of these features reduce the heat transfer into the ducts.

DESCRIPTION OF THE INVENTION

It is an object of the present invention to provide a new and improved cooling plate for furnaces in order to improve cooling conditions for a fireproof furnace lining and a furnace jacket.

In accordance with the preferred embodiment of the invention, it is suggested to provide a copper, or low-alloyed copper alloy ingot and to forge or roll this ingot into a plate. Preferably, the plate is straightened thereafter. Next, blind bores are deep-drilled into the plate to extend from one narrow edge almost to the opposite edge, running directly underneath and parallel to the wide flat surfaces of the plate. The plate is preferably provided, in addition, with means for holding fireproof material. Moreover, connections to the bores (the drilling ends having been closed) are made to pass a coolant therethrough; preferably, short ducts are drilled from the rear side of the plate to the drilled bores and near the two ends of each such bore. Short tubes or sleeves are welded to these ducts as extensions thereof and for the purpose of connecting the plate with the bores into the flow path of a coolant.

The cooling plate, as per the invention, is much denser, and very homogenic, as compared with a cast copper plate. Cast copper plates include frequently shrink holes, resulting in voids. No such voids will be found in forged or rolled plates. The novel plates are stronger, and the thermal conductivity is not only higher but more uniform throughout the material. The bores will, more readily, have an accurately predetermined disposition, orientation, and spacing so that the heat transfer conditions can be better predetermined.

The side of the cooling plate facing the interior of the furnace is usually to be lined or covered with fireproof bricks, or another fireproof material. The surface portion directly exposed to the furnace chamber is thus reduced. Should some of the fireproof lining, or a part thereof, break off, the heat transfer out of the furnace chamber would be limited so that the chamber itself would not be cooled unduly. This is an important fact as any outflow of heat from the furnace chamber has to be compensated by additional heating for reasons of metallurgy. Nevertheless, the plates must be cooled sufficiently to maintain their temperature, well below the softening point of copper.

DESCRIPTION OF THE DRAWINGS

While the specification concludes with claims, particularly pointing out and distinctly claiming the subject matter which is regarded as the invention, it is believed that the invention, the objects and features of the invention, and further objects, features, and advantages thereof, will be better understood from the following description taken in connection with the accompanying drawings, in which:

FIG. 4 is a view similar to FIG. 1, except that the plate is constructed to hold fireproof material other then bricks;

FIG. 5 is a section view taken along line 5—5 in FIG. 4; and

FIG. 6 is a cross-section equivalent to FIG. 3, but showing a modification.

Figure 1:
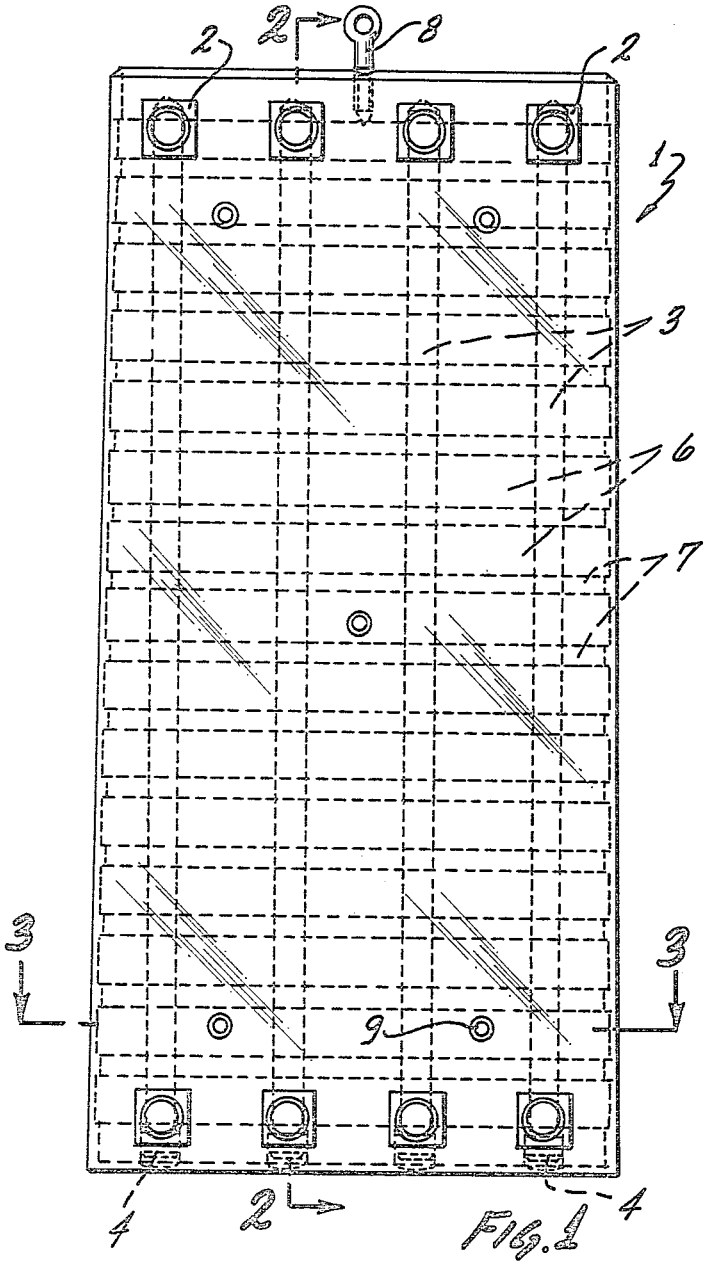
FIG. 1 is a side elevation of a flat cooling device in accordance with the preferred embodiment of the present invention and constituting the best mode of practicing same.

Proceeding now to the detailed description of the invention and the drawings, a blank is made by forging or rolling a block or ingot into a plate; the ingot being a copper ingot, or an ingot made of a low-alloyed copper alloy. Forging or rolling results in a very dense and homogenic texture, ensuring later a high degree of uniformity in the heat transfer through the material. The plate is subsequently straightened to ensure proper dimensions and orientation. The plate is to be used as one of many in a blast furnace, and care must be taken already during the earlier manufacturing steps, so that the plate will readily fit with others into the wall and case structure of the furnace.

Next, the narrow edges as well as the rear-surface (to the right in FIG. 2, the surface opposite the one shown at the top elevation of FIG. 1) are milled. Previously, short bores 32 have been drilled into the plate from the rear. Also, nipples 2 have been forged, or the like, to the plate as extensions of bores 32. These nipples are not cut off by the milling cutter.

Next, blind bores 3 are deep-drilled into plate 1, beginning at one small edge; the bores extend almost all the way through the plate and end just short of the opposite edge. The open ends of the bores are then plugged, preferably by means of screw plugs 4 which are additionally welded or soldered to ensure tight closure of the bores. Short tubes or sleeves 5 are welded or soldered to nipples 2 to serve as extensions. Later, i.e., after the plate has been installed in a furnace, conduits will be connected to these tubes to feed a coolant thereto, or to discharge the coolant therefrom. For this reason, one provides these inlet and outlet ducts (ducts 5, 2, and 32) as close as possible to the ends of bores 3.

Next, grooves 6 are cut into the one broad side of the plate. These grooves extend parallel to each other and leave ridges in between. These ridges may have any kind of cross-sectional profile; but they preferably have a trapezoidal profile to result in overhung edges. The grooves 6 are thus undercut in a length direction, and they are to be filled later with a fireproof material (bricks). The undercut configuration of the grooves holds and clamps these bricks in place.

After the various milling and drilling operations have been completed, the plate is straightened again. If so desired, a hook 8 for facilitating transportation is screwed into a bore of the plate. Several threaded bores 9 are tapped into the plate, preferably in a rather uniform pattern. Bores 9 serve to fasten the plate to the blast furnace jacket.

Figure 2:
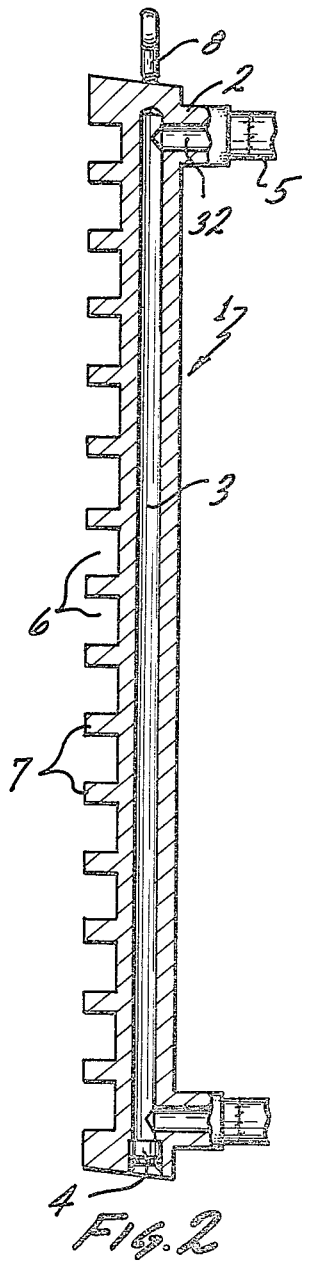
FIGS. 2 and 3 are section views as respectively indicated by lines 2—2 and 3—3 in FIG. 1.

The quadrilateral plate 1, as shown, tapers slightly in upward direction (as shown and oriented in FIG. 1), and FIG. 2 reveals a slight inward taper of the lower edge and an outward taper of the upper edge of this plate. All of these features are provided to better conform the plate to the contour of the furnace. The plates are mounted in the furnace with an inward inclination of the top. Also, the spacing between the various plates is uniformly small in order to obtain the desired areal cooling.

Figure 3:
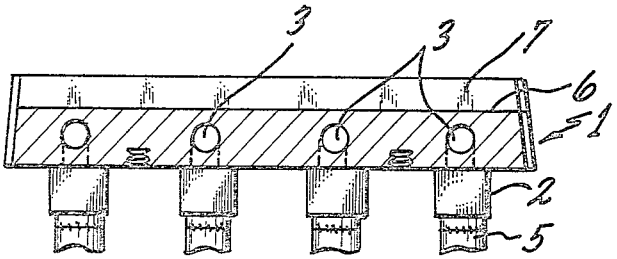

FIG. 3 reveals that the long plate edges are also tapered. It will be observed that the interior of a blast furnace has a circular cross-section, as seen from the top of such a furnace (not shown). Due to the taper of the long plate edge, juxtaposed plates have an angle to each other, and all plates together approximate that circular contour of the furnace by a multifaceted polygon.

As stated, bricks are shifted into grooves 6 of the plate shown in FIGS. 1, 2, and 3. The plate 1', shown in FIGS. 4 and 5, is constructed in such a way that it accommodates a fireproof material to be applied otherwise.

Plate 1', shown in FIGS. 4 and 5, is also provided with bores 3, nipples 2, tubes 5, and plugs 4 as described. However, plate 1' is thinner; and shallow, circular grooves 11 have been cut into one surface. Short sleeves 10 (or pins) are inserted in these grooves 11 and are welded to the plate. are inserted in these grooves 11 and are welded to the plate. These sleeves 10 will serve as holders for a suitably applied fireproof lining.

The interface between the plate material and the sleeves 10 should provide for unimpeded heat flow between these parts. These conditions are established by several features. First of all, the end of each sleeve 10 abuts with the plate material. Welding seams 12, moreover, provide additional paths for heat transfer.

Bores 11 are slightly tapered (bevelled) outwardly, and the resulting V-shaped gap between the inserted sleeves 10 and the side wall of the respective groove will be filled with soldering or welding material. This way, a wide, thermal conductive path between the plate material and the sleeves will not depend on accuracy of milling; but the molten welding or soldering material ensures broad and intimate surface-to-surface contact.

It should be noted, however, that one may dispense with the grooves 11 and weld directly one front end of each sleeve 10 to the flat surface of plate 1'. The welding material or solder material should have a good thermal conductivity in either case As can be seen in the various views, each bore 3 has two duct means at or adjacent to its ends, for connection to a cooling line. Alternatively, one may drill manifold bores from the long, narrow edges to interconnect two or more blind bores 3; this is shown by way of example in FIG. 6. The manifold bores, such as bore 31, may also be blind bores, interconnecting two main bores 3; and the open end of bore 31, on its drilling side, is plugged by a plug 41, similar to plug 4. A transverse duct 33 ends in a manifold duct and, thus, drains or feeds two main coolant duct bores 3. The number of bores so manifolded may vary. The manifold ducts, such as duct 31, have preferably a diameter which is larger than the diameter of bores 3.

It can thus be seen that the various plates as depicted and described exhibit optimized properties with regard to heat transfer. Particularly instrumental in this respect is the deep drilling of cooling channels into a forged or rolled copper or copper alloy plate. The plate is quite uniformly cooled.

The invention is not limited to the embodiments described above; but all changes and modifications thereof, not constituting departures from the spirit and scope of the invention, are intended to be included.

We claim:

1. A cooling plate for pit furnaces, such as blast furnaces, comprising:
   - a quadrilateral, forged or rolled single-piece plate made of copper or a low-alloyed copper alloy and being of integral construction;
   - deep-drilled blind bores, extending from one narrow side through the plate toward the opposite narrow side; and
   - means on the plate for holding a fireproof material.

2. The plate as in claim 1, said bores being closed by soldered or welded plugs, there being duct means leading into the bores.

3. The plate as in claim 2, the duct means including each an integral nipple and a sleeve welded to the nipple, extending from a side opposite the side having the means for holding.

4. The plate as in claim 2, one of the duct means being near one end of the respective bore, and another one of the duct means being near the opposite end of the bore.

5. A cooling plate for pit furnaces, such as blast furnaces, comprising:
   - a quadrilateral, forged or rolled single-piece plate made of copper or of a low-alloywed copper alloy and being of integral construction;
   - deep-drilled blind bores, extending from one narrow side through the plate, almost to the opposite narrow side;
   - plug means for closing the bores; and duct means disposed to communicate from one of two wide, flat sides of the plates with the blind bores, near respective ends adjacent to two of said opposite plate sides as well as adjacent to the respective plug means.

6. A cooling plate as in claim 2 or 5, there being two duct means per bore.

7. Plate as in claim 5, wherein at least two of the bores are interconnected by manifold duct means, the duct means provided to communicate with the manifold duct means.

8. Plate as in claim 7, the manifold duct means having a diameter which is larger than the diameter of the bores.

9. A plate as in claim 5, wherein the other one of the two flat sides includes means for holding fireproof material.

10. A plate as in claim 1 or 9, the means for holding being short, circular elements welded to the plate.

11. A plate as in claim 1 or 9, the means for holding being grooves in one surface of the plate, the grooves extending transversely to bores.

12. The method of making a cooling plate, comprising the steps of rolling or forging a copper or copper alloy single-piece ingot into a quadrilateral single-piece plate of integral construction;

deep-drilling long, blind bores into the plate, beginning from one small edge of the plate and extending almost to the opposite small edge;

plugging the blind bores from their respective open end; and providing lateral inlet and outlet duct means for the bores in the plate and from one of its flat surfaces.

13. A method as in claim 12 and including the step of straightening the plate at least once after the rolling and forging step.

14. A method as in claim 12 or 13, including working the edges and the one flat surface by milling.

15. A method as in claim 13 and including milling grooves into the opposite flat surface.

16. The plate made in accordance with the method of claim 12.

* * * * *